US008731746B2

(12) United States Patent
Weiler

(10) Patent No.: US 8,731,746 B2
(45) Date of Patent: May 20, 2014

(54) INTEGRATED DATA SYSTEM FOR RAILROAD FREIGHT TRAFFIC

(75) Inventor: Dan Weiler, Portland, OR (US)

(73) Assignee: Greenbrier Management Services, LLC, Lake Oswego, OR (US)

( * ) Notice: Subject to any disclaimer, the term of this patent is extended or adjusted under 35 U.S.C. 154(b) by 1498 days.

(21) Appl. No.: 12/129,598

(22) Filed: May 29, 2008

(65) Prior Publication Data

US 2009/0299623 A1 Dec. 3, 2009

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.

USPC ..... 701/19; 701/1; 701/400; 701/521; 701/527

(58) Field of Classification Search

USPC ..... 701/19, 29, 203, 204

See application file for complete search history.

(56) References Cited

U.S. PATENT DOCUMENTS

| | | | | | |
|---|---|---|---|---|---|
| 3,886,515 | A * | 5/1975 | Cottin et al. | ..... | 340/994 |
| 5,129,605 | A * | 7/1992 | Burns et al. | ..... | 246/5 |
| 5,353,413 | A * | 10/1994 | Novakovich et al. | ..... | 710/110 |
| 5,400,020 | A * | 3/1995 | Jones et al. | ..... | 340/994 |
| 5,541,845 | A * | 7/1996 | Klein | ..... | 701/446 |
| 5,828,979 | A * | 10/1998 | Polivka et al. | ..... | 701/117 |
| 5,867,122 | A * | 2/1999 | Zahm et al. | ..... | 342/357.33 |
| 5,987,377 | A * | 11/1999 | Westerlage et al. | ..... | 701/454 |
| 6,006,159 | A * | 12/1999 | Schmier et al. | ..... | 701/465 |
| 6,124,810 | A * | 9/2000 | Segal et al. | ..... | 340/994 |
| 6,240,362 | B1 * | 5/2001 | Gaspard, II | ..... | 701/410 |
| 6,249,741 | B1 * | 6/2001 | Iwasaki et al. | ..... | 705/7.16 |
| 6,374,176 | B1 * | 4/2002 | Schmier et al. | ..... | 701/465 |
| 6,377,890 | B1 * | 4/2002 | Doi | ..... | 701/431 |
| 6,421,587 | B2 * | 7/2002 | Diana et al. | ..... | 701/19 |
| 6,490,523 | B2 * | 12/2002 | Doner | ..... | 701/482 |
| 6,563,430 | B1 * | 5/2003 | Kemink et al. | ..... | 340/8.1 |
| 6,700,506 | B1 * | 3/2004 | Winkler et al. | ..... | 340/994 |
| 6,873,962 | B1 * | 3/2005 | Doner | ..... | 705/7.22 |
| 6,934,624 | B2 * | 8/2005 | Deh-Lee | ..... | 701/465 |
| 6,958,709 | B2 * | 10/2005 | Izbicki et al. | ..... | 340/994 |
| 7,394,403 | B2 * | 7/2008 | Winkler et al. | ..... | 340/994 |
| 7,742,849 | B2 * | 6/2010 | Muinonen et al. | ..... | 701/19 |
| 8,190,312 | B2 * | 5/2012 | Nandedkar et al. | ..... | 701/19 |
| 2002/0062181 | A1 * | 5/2002 | Polivka et al. | ..... | 701/19 |
| 2002/0091486 | A1 * | 7/2002 | Hubschneider et al. | ..... | 701/209 |
| 2004/0083054 | A1 * | 4/2004 | Jones | ..... | 701/200 |
| 2004/0245410 | A1 * | 12/2004 | Kisak et al. | ..... | 246/3 |
| 2005/0010338 | A1 * | 1/2005 | Kraeling et al. | ..... | 701/19 |
| 2005/0205719 | A1 * | 9/2005 | Hendrickson et al. | .... | 246/122 R |
| 2006/0047379 | A1 * | 3/2006 | Schullian et al. | ..... | 701/19 |
| 2007/0156309 | A1 * | 7/2007 | Muinonen et al. | ..... | 701/19 |
| 2008/0109124 | A1 * | 5/2008 | Daum et al. | ..... | 701/19 |
| 2009/0299623 | A1 * | 12/2009 | Weiler | ..... | 701/203 |

* cited by examiner

*Primary Examiner* — Bhavesh V Amin

(74) *Attorney, Agent, or Firm* — Chernoff Vilhauer McClung & Stenzel, LLP

(57) ABSTRACT

A system for modifying CLM-based statistical data using received GPS data.

15 Claims, 4 Drawing Sheets

INTEGRATED DATA SYSTEM FOR RAILROAD FREIGHT TRAFFIC

BACKGROUND OF THE INVENTION

The present invention relates to a system for the reliable estimation of unknown information regarding railroad freight vehicles in transit.

A railroad track network exists throughout North America, upon which railroad freight traffic flows. This railroad track network, though owned by a comparatively small number of entities, e.g., Union Pacific, Burlington Northern Santa Fe, etc., is shared by a vast number of railroad freight carriers. In addition, many businesses neither own the railroad track, nor engage in hauling freight across it, but instead merely own specific equipment such as railroad cars, ocean containers and other intermodal equipment, etc., that is used by railroad freight carriers on a rental basis. Furthermore, to facilitate the most efficient use of the finite railroad track network, individual units of railroad equipment are shared among all freight carriers according to standardized use and compensation rules promulgated by RailInc., a wholly owned subsidiary of the Association of American Railroads. That is to say, when a particular railcar arrives at a destination and is unloaded of its cargo, it may then be made available to another freight carrier, loaded with new cargo, and thereafter depart for a new destination.

In order to most efficiently manage a system that shares both railroad track and railroad equipment, a standardized informational database is necessary to identify individual railroad freight equipment, track their respective movements, assign available equipment to freight carriers, and account for the value of using particular equipment. As one example, if a railroad freight carrier is expecting 500 ocean containers to arrive at a port, at a particular future date, for rail transport elsewhere, sufficient railroad cars will need to be assigned to it on that date and at that location. If it were possible to identify rail cars already in transit, but whose destination for unloading its cargo was either at the needed location or sufficiently close to the needed location, and whose estimated time of arrival is sufficiently close to the time needed, then few, if any, rail cars would have to remain empty for a significant period of time just to meet the anticipated needs of that freight carrier. Thus, as can readily be seen, the use of the railroad track network will be more efficient as the detail and accuracy of such an informational database increases. Early efforts at developing a standardized database of railroad equipment were relatively simple. In the late 1960s, the Association of American Railroads (AAR) developed a crude optical identification system, called Automatic Car Identification (ACI), in which mandatory color-coded labels were mounted to the side of individual rail cars and other railroad equipment. Due to several factors, however, including deterioration and obfuscation of the labels by dust etc., the system's accuracy was very low, and was abandoned in the 1970s.

In the mid-1980s, Burlington Northern developed a prototype informational database of railroad freight equipment that was patterned after similar systems then used by various maritime shipping companies. Specifically, the prototype database utilized radio transponders mounted to freight equipment to broadcast a signal comprising a unique identifier for the respective equipment to which the transponder was mounted. These signals were then read by wayside reader sites positioned adjacent a railroad track at selected intervals. This prototype system proved to be virtually 100% effective at relaying the identification code of a railcar or other equipment passing a reader site.

Based on these results, the Association of American Railroads wrote an Automatic Equipment Identification (AEI) standard for the North American rail industry that produced a transponder/reader specification including a data format for an identification tag to singularly identify of a piece of railroad equipment. This standard was later made mandatory, and by 1994 all 1.4 million rail cars in North American interchange service were to be tagged in accordance with the standard adopted. Over 3,000 readers have been installed by the railways in North America as of the Dec. 31, 2000.

In practice, as a rail car passes an AEI reader, the RF transponder broadcasts a signal comprising a time stamp, an identification code for the rail car, and an identification code for the AEI reader. These signals, called car location messages (CLM) are then relayed to a central database for data processing to hack the physical location of rail cars on the railroad track network.

In the years since the adoption of the AEI standard, relatively sophisticated techniques have been developed to analyze the CLM data received from the respective transponders of railroad equipment in transport across the North American railroad network. For example, virtually all embarkation and destination locations include AEI readers that record the departure and arrival time of railroad equipment. Over time, the CLM data received from the departure and arrival points, along with CLM data received from intermediate AEI readers enroute have been used to develop increasingly accurate statistical relationships between pairs of AEI readers. For example, where a system has stored a statistically significant number of previous CLM readings of individual units of rail car equipment at a particular embarkation AEI reader, all having arrived at another particular destination with its own AEI reader, the average time of arrival at the destination from the embarkation point, and other statistical measures are contemporaneously computed as a next unit of railcar equipment sends a CLM message as it departs en-route to that destination, so that an estimated time of arrival (ETA), along with a numerical confidence measure of that arrival time (e.g., variance or standard deviations), are computed. Moreover, as the railcar passes other AEI readers en-route, this ETA and its associated confidence are updated from the statistical data relating rail car traffic between that intermediate AEI reader and the AEI reader at the destination.

As can easily be appreciated, the AEI specification thus enables planners to efficiently assign rail cars to freight carriers for particular transportation requirements, by using the foregoing ETA computations, along with other appropriate statistical measures.

This is not to say, however, that the existing system is either perfectly efficient or anywhere near so. One of the primary inefficiencies results from a combination of the sparseness of AEI readers along many routes, along with the number of intervening junctions, etc. between AEI readers. For example, it is not uncommon for several hundreds of miles to elapse between CLM messages from AEI readers along specific routes, particularly in the western portions of the United States and Canada. Between these AEI readers are many potential junctions, enabling multiple different paths to a single destination from any given AEI reader. Thus, even where a statistically significant number of prior instances of travel between a given AEI reader and a given destination may produce an average (or estimated) time of arrival, the spread or deviation about that average may be significant, translating to a low confidence in that ETA. Moreover, even in areas where AEI readers are dense, i.e., near major cities like Chicago, these areas typically experience a higher than average chance of backlogs where rail cars simply sit on a track waiting for the route ahead to become available. This, also, tends to increase the variance about the average historical arrival time, frustrating somewhat the ability to plan on the basis of the estimated arrival times provided. Thus, while the ability to use historical statistical interrelationships between two arbitrary AEI readers greatly assists the efficient use of a shared railroad network, there nonetheless still exists a large amount of inefficiency, minimization of which would be desirable.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

DETAILED DESCRIPTION OF PREFERRED EMBODIMENTS

Figure 1:
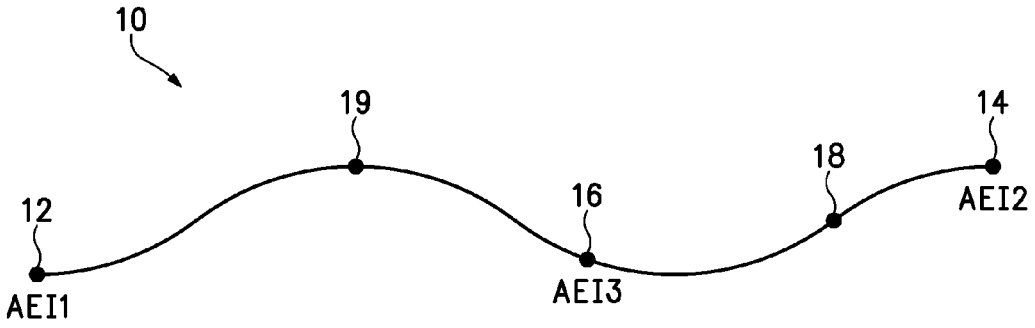
FIG. 1 shows a diagram of a portion of railroad track having a plurality of AEI readers interspersed thereon.

In this specification, the term "railroad" should be understood to encompass any entity engaged in the commercial transport of cargo over railroad track using railroad transport equipment. Also, the term "rail car" should be understood to encompass not only rail cars such as box cars, hopper cars, and the like, but also any other piece of railroad equipment, e.g., intermodal equipment, that travels over a railroad track and is used to deliver cargo. In addition to the foregoing terms, the following terms will be accorded the meanings that respectively follow them, which should already be understood by those familiar with the art. These meanings are provided to facilitate understanding of the specification by those unskilled in the art, as well:

Automatic Equipment Identification (AEI) reader—a wayside reader along a railroad track that receives RF signals from a passing railcar to identify the identification code of the passing railcar and the time of passage.

Car Location Messages (CLM)—messages respectively sent from an AEI reader comprising the SPLC code of the AEI reader, the equipment mark of a vehicle passing the reader, and a time stamp.

Centralized Station Master File (CSMF): A geographic location IRF containing data about rail and motor carrier points for North America and international areas used by railroads to help plan freight movements from origin to destination in an efficient and timely manner.

Equipment Mark: A unique identifier for a piece of railroad or intermodal equipment, consisting of a two to four letter identifier followed by a number up to six digits long, i.e., ABCD 123456. Sometimes used interchangeably with the term Equipment Mark, but sometimes merely referring to the two to four letter identifier.

Equipment Number: A unique identifier for a piece of railroad or intermodal equipment, consisting of a two to four letter identifier followed by a number up to six digits long, i.e., ABCD 123456. Sometimes used interchangeably with the term Equipment Mark, but sometimes merely referring to the six digit number.

Estimated Time of Arrival (ETA)—a prediction of a future arrival time of a rail car or other equipment at a destination, and usually calculated using a statistical analysis of prior times of arrival at the destination from points of departure or points en-route, recorded using CLM data sent from AEI readers.

Global Positioning System (GPS)—a system for determining the physical location of an object carrying a receiver that is capable of automatically determining its location relative to multiple orbital satellites, each broadcasting a signal at a particular microwave frequency. Specifically, each satellite includes an atomic clock by which time codes can be continuously broadcast. A receiver will receive, at different reception times, time codes respectively sent from four or more different satellites at the same time. Throwing the travel time and the frequency of each signal, the receiver can calculate its distance to each satellite, and thereby pinpoint it's location on the globe in latitude and longitude coordinates. Using the respective satellite signals over a very short interval of time, a receiver can also calculate the speed and direction (velocity) at which it is moving.

Great Circle Distance Formula—a mathematical expression used to calculate the linear distance between two coordinates expressed in latitude and longitude. Specifically, the formula is:

$$3963*\arccos\{\sin(lat1)*\sin(lat2)+\cos(lat1)*\cos(lat2)*\cos(lon2-lon1)\}$$

where lat1/lon1 is one location and lat2/lon2 is the second location.

Industry Reference File (IRF): File representations of standardized data maintained by Railnc and distributed to the North America Railroad Industry. Files include the Customer Identification File (DIF), Mark Register File (MARK), Route File (ROUTE), Shipment Conditions File (SCF), Serving Carrier/Reciprocal Switch (SCRS) File and the Standardized Transportation Commodity Code (STCC) File.

RailInc: A wholly owned subsidiary of the Association of American Railroads providing information technology and related services to North America's railroads.

Railroad Transport Equipment: Equipment used to move cargo over railroad tracks. Specific examples include, but are not limited to, rail cars, cargo containers placed on rail cars, and appurtenances such as automobile racks inserted into rail cars.

Standard Point Location Code: A six to nine digit numeric code assigned to a railroad station and AEI readers to specify the physical location of the readers.

With the foregoing definitions established, FIG. 1 shows an exemplary section of rail track 10 that includes, for purposes of illustrating the system disclosed herein, a first AEI reader 12, a second AEI reader 14, and a third AEI 16 reader positioned between the first and second AEI readers 12 and 14, respectively. The AEI readers 12, 14, and 16 are constructed and positioned to transmit a signal to the transponder of a passing railcar. The transponder replies with an ID code of the rail car carrying the transponder. The AEI reader relays the received ID code, along with its own identifier and a time stamp (collectively comprising a CLM message) to a centralized industry collection mechanism for inclusion in a database of CLM messages. This database is then analyzed to provide an estimated time of arrival or other meaningful estimate.

As noted previously, the prior art statistical analysis of the CLM messages provided by the AEI readers 12, 14, and 16, while extremely beneficial, is not as accurate as might be desired. Specifically, where the distances between readers are large, where there are multiple routes between a reader and a destination, and/or where there are significant bottlenecks following an AEI reader, an ETA or other statistical measure may not be reliable due to an unacceptably large spread or variance about the reported past average ETA or other statistical measure.

Some existing rail cars are being equipped with GPS receivers that may be selectively activated so as to determine the precise location of a railcar, along with its velocity for security or maintenance purposes. Unlike CLM messages, however, GPS readings cannot be easily compiled in a statistical database so as to compute average/estimated arrival times. CLM messages analyze a large number of readings taken at individual, non-varying locations but at different points in time, i.e. different trips. The fact that different railcars, on different trips to the same destination, transmit CLM messages at precisely the same location is what permits the different cars/different trips to be compiled in the same database, with their ultimate arrival times meaningfully averaged. GPS readings, however, are too disparate to be readily combined, i.e. it is highly unlikely that any two railcars will transmit respective GPS readings at precisely the same location, or even generally the same location. If, for example, if respective GPS readings from different cars on different trips are fifty miles apart, the respective arrival times cannot be meaningfully averaged because of the difference in the distance they each traveled to the destination following the reading.

The present inventors, however, considered the possibility that GPS readings from rail cars en route, when available, might be used to augment or filter the statistically significant CLM data received from the AEI readers. Again, however, the prospect for meaningfully combining such disparate data streams is daunting, as illustrated by the following table, which describes sample GPS and CLM data streams from the same car on the same trip.

| Time | GPS Data | CLM Data |
|---|---|---|
| 12:00:00 | 45.5056, −122.631 | |
| 14:00:00 | 45.4671, −122.659 | |
| 12:37:15 | | 858923000 |
| 16:00:00 | 45,4671, −122.659 | |
| 18:00:00 | 45.4860, −122.650 | |
| 19:22:44 | | 859705000 |
| 20:00:00 | 4535050, −122.645 | |
| 22:00:00 | 4537149, −121.506 | |
| 22:13:51 | | 859183000 |

As can be seen, the GPS readings are received at regular time intervals and expressed in latitude and longitude coordinates, while the CLM readings for a given car are at irregular times and expressed merely as the code of the AEI reader that the car passes when giving the CLM reading.

Figure 2A:
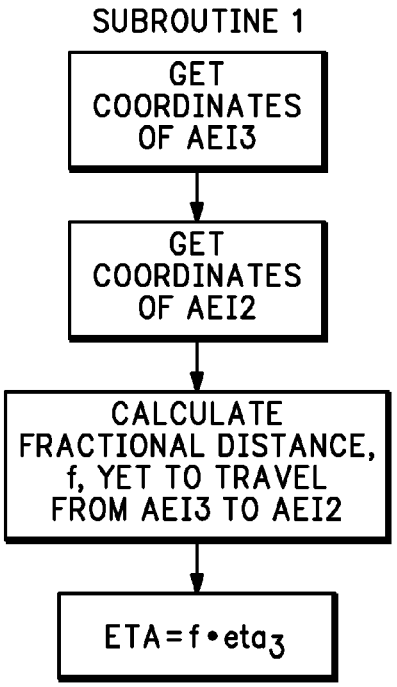
FIG. 2A shows a first subroutine for a first improved method of calculating an ETA at AEI reader 2 of FIG. 1.

Nonetheless, the present inventors determined that the GPS data and the CLM data could be combined in a meaningful manner to improve or update the statistical parameters calculated from the CLM data received from AEI readers. Referring to FIGS. 1 and 2A, a railcar en route between AEI reader 16 and AEI reader 14 (assumed to be the destination), and equipped with a GPS receiver, transmits a GPS locator signal at a location 18. Sufficient data exist to statistically correlate a reading at AEI reader 16 with an average (estimated) time of arrival at the destination AEI reader 14. First, the respective locations of the AEI readers 14 and 16 are converted to latitude and longitude coordinates. Second, if necessary, the ETA calculated in response to the CLM reading at AEI reader 16 is expressed as an elapsed time in continuous units, e.g. 1,240 minutes or 15.9 hours, as opposed to 29 hours, 12 minutes, 43 seconds. After these conversions, the GPS locator signal may then be used to update the prior ETA computed in response to the CLM reading from AEI reader 16 by using the Great Circle Distance Formula (GCDF) to determine a multiplier between 0 and 1. Specifically, the Great Circle Distance Formula is used first to determine the linear distance between AEI readers 14 and 16, and second to determine the linear distance between the location of the GPS reading and the location of AEI reader 14. The ratio of the latter to the former is the multiplier, which is multiplied by the ETA to give an updated time of arrival at the destination, i.e.

$$\text{ETA(GPS)}=\text{ETA(AEI0}*m\text{, where}$$

$$m=\text{GCDF(GPS 18,AEI 14)/GCDF(AEI 14,AEI 16)}$$

m being the calculated multiplier, GCDF(GPS 18, AEI 14) being the distance between GPS reading 18 and AEI reader 14 calculated using the Great Circle Distance Formula, etc., ETA(AEI) being the estimated time of arrival based on the statistical data associated with AEI readers 14 and 16, and ETA(GPS) being the modified ETA based on the newly-received GPS data.

Figure 2B:
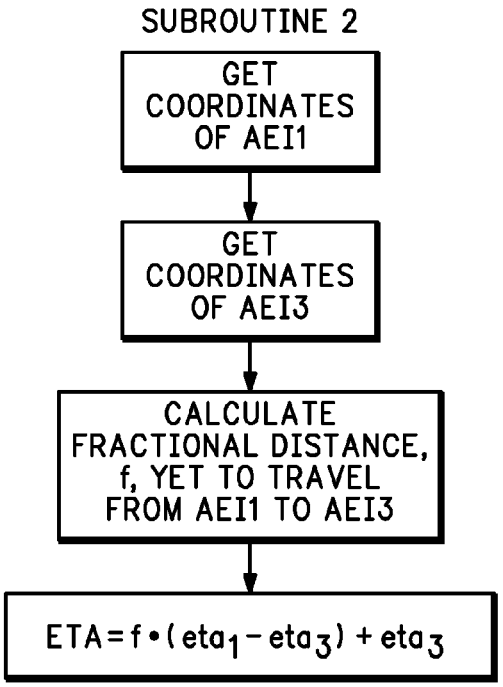
FIG. 2B shows a second subroutine for a second improved of calculating an ETA at AEI reader 2 of FIG. 1.
Figure 2C:
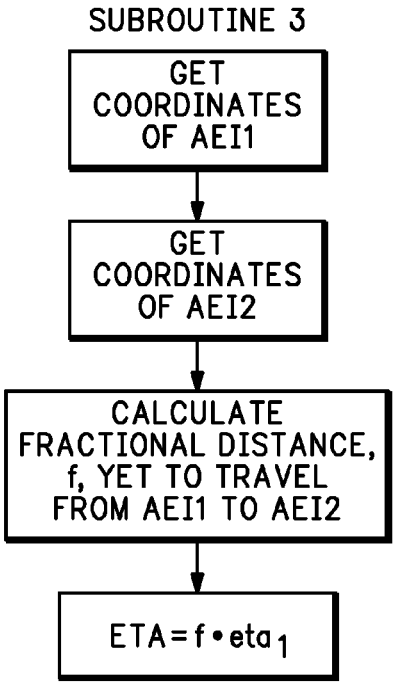
FIG. 2C shows a third subroutine for a third improved method of calculating an ETA at AEI reader 2 of FIG. 1.

Referring to FIGS. 1, 2B and 2C, either of two modified systems may be used in the event that a GPS reading is received between two intermediate AEI readers, i.e. there is an AEI reader between the location of the GPS reading and the destination, such as an exemplary GPS reading 19 of FIG. 1, in which AEI reader 16 intervenes between the destination AEI reader 14. First, as illustrated in FIG. 2C, the GPS reading may be used to modify the ETA provided by the prior AEI reader 12. In that instance, the Great Circle Distance Formula is used in the same manner just described, i.e. it is used to calculate the fractional distance between AEI readers 1 and 2 that the rail car has yet to travel, based on the recent GPS reading. The multiplier is then multiplied by the ETA of AEI reader 1.

Alternatively, as shown n FIG. 2B, the ETA of AEI reader 16 may be used, if desired, in which case the calculations change slightly. In this instance, the Great Circle Distance Formula is used to calculate the fractional distance that the rail car has traveled between AEI readers 12 and 16, based on the recent GPS reading 19. This fractional distance, however, is used as a multiplier in the following equation:

$$\text{ETA(GPS)}=\text{ETA(AEI 16)}+m*[\text{ETA(AEI 12)—ETA (AEI 16)}]$$

Essentially, this formula calculates an estimated fractional time a car has yet to travel between reader 12 and AEI reader 16, and adds that time to the ETA of AEI reader 16.

An alternative to this latter equation is to recalculate an ETA from a recently passed AEI reader to the next AEI reader en route, if it can be determined, e.g. recalculate an ETA from AEI reader 12 to arrive at AEI reader 14 using the same statistical database used to calculate the ETA at AEI reader 14. This recalculation may be made based on raw data already compiled in existing CLM data systems, and may provide more accurate results. In this latter circumstance, the Great Circle Distance formula is used to determine the fractional distance traveled between AEI readers 12 and 16, which is multiplied by the recalculated ETA at AEI reader 16 and the product added to the ETA to arrive at the destination reader 14 from AEI reader 16.

Figure 3:
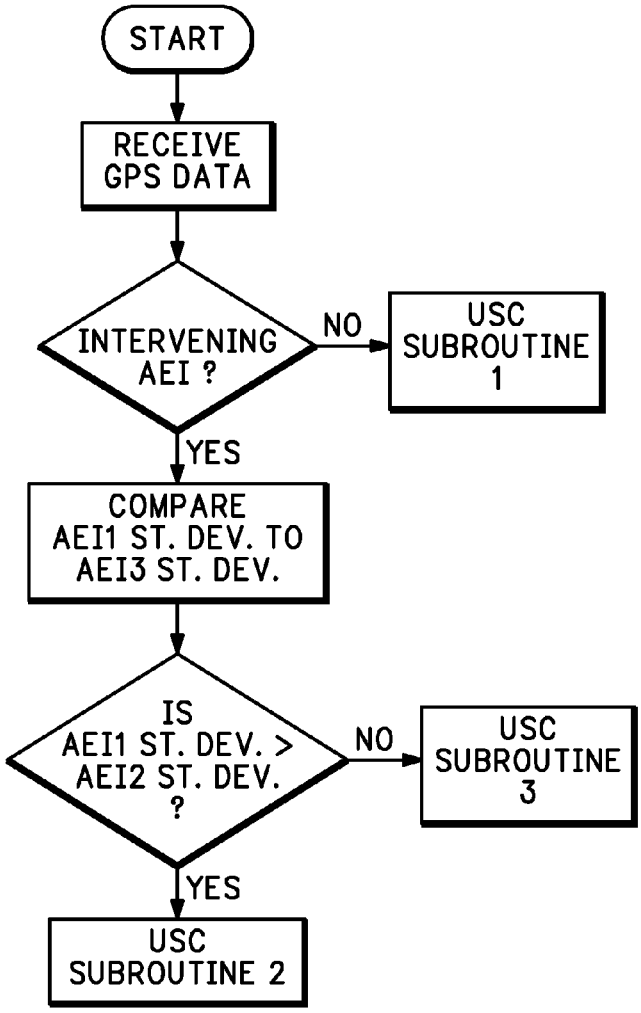
FIG. 3 shows a flowchart for a method that integrates the subroutines of FIGS. 2A, 2B, and 2C.
Figure 4A:
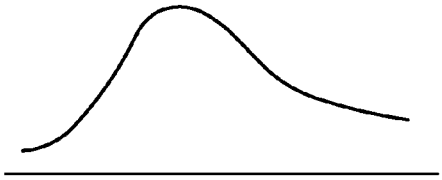
FIG. 4A shows a first exemplary probability distribution associated with AEI reader 1 of FIG. 1.
Figure 4B:
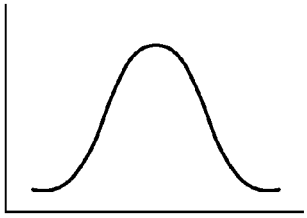
FIG. 4B shows a second exemplary probability distribution associated with AEI reader 1 of FIG. 1.

Referring to FIGS. 3, 4A and 4B, each of the systems of FIGS. 2A-2C may be integrated into a single system that utilizes the coordinates of GPS reading relative to nearby AEI readers, along with the respective probability distributions of those AEI readers, to determine the optimal one of the respective systems shown in FIGS. 2A to 2C to use. As an introductory note, each AEI reader has an associated estimated or average ETA for a given destination that is spread over a probability distribution, as it is generally the case that as a rail car travels closer to its destination, the probability distributions of associated AEI readers should tighten as the car draws nearer the destination. This is generally the case because the closer the car gets, the less possible routes there are to the destination, the less possible mishaps that could happen, etc. This situation is graphically illustrated by FIGS. 4A and 4B, where FIG. 4B represents a probability distribution of an AEI reader closer to a destination than an AEI reader associated with the distribution of FIG. 4A. While generally true however, there may be certain circumstances in which the probability distribution expands, i.e. becomes more uncertain, the closer the car gets to a destination. For example, in certain high-traffic areas, such as a large inner city, bottlenecks may occur which lead to a large spread in ETAs from readers very close to the point of arrival. Alternatively, one AEI reader may be newly placed relative to an adjacent one.

With this in mind, and referring to FIG. 3, an integrated system may receive GPS data and compare the received location to the location of AEI readers at the destination and en route. If there are no intervening AEI readers between the GPS location and the destination, then the subroutine of FIG. 2A is used because there is no other AEI reader, with an associated ETA to modify, that could possibly give a better estimate than the last reader to the destination when that reader has already been passed.

If, however, there is an intervening AEI reader between the GPS location and the destination AEI reader, then the system compares the probability distributions respectively associated with the next intervening AEI reader and the closest preceding AEI reader. If the latter has a selected reliability parameter, such as variance, standard deviation, etc., that is the more reliable of the two, then the subroutine of FIG. 2C is used, otherwise the subroutine of FIG. 2B is used. In this manner, the GPS reading is used to modify the most reliable available CLM data.

Each of the foregoing methods utilize the great distance formula to modify estimated times of arrival or other meaningful statistical parameters associated with a fixed AEI location. The great distance formula, however, is inexact because it merely measures the linear distance between two coordinates, whereas an actual route of travel may follow a more circuitous path. Therefore, rather than using the Great Circle Distance Formula, it may be preferable to filter or otherwise modify a probability distribution of an adjacent AEI reader, using a GPS reading en route, without resort to the Great Circle Distance Formula.

Figure 5:
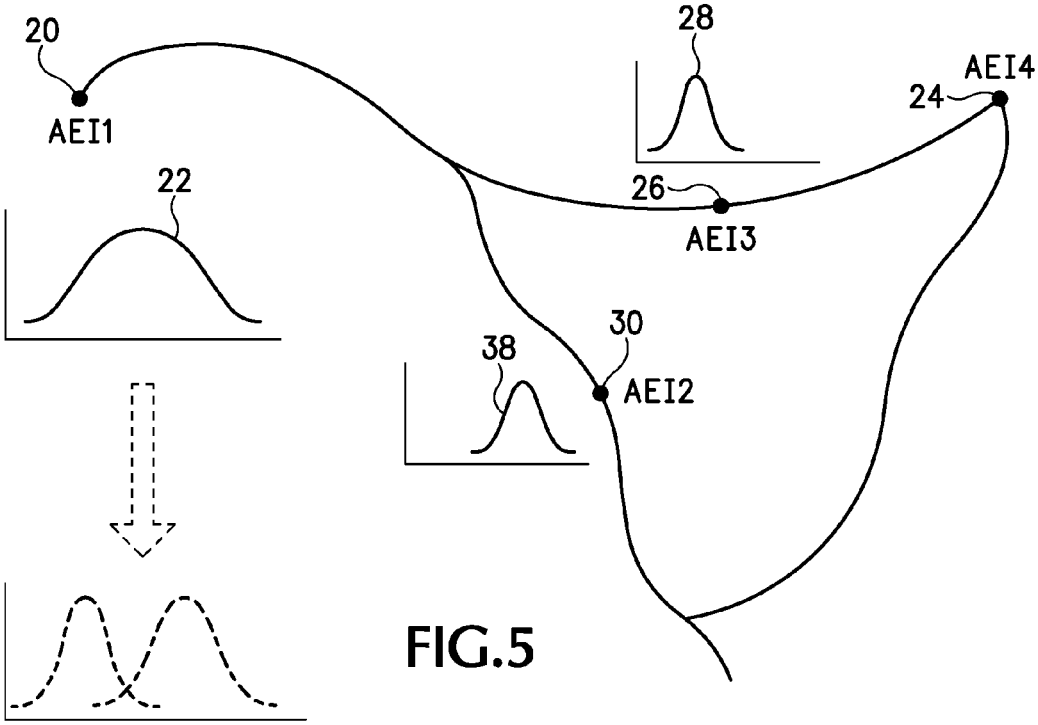
FIG. 5 shows a portion of a railroad track having a plurality of AEI readers and showing probability distributions for a statistical parameter associated with the respective AEI readers.

For example, in many circumstances, the variance in actual times of arrival at a destination from a given AEI reader may be the result of different cars taking different available routes to the destination, of varying lengths, delays, etc. This circumstance should be apparent by simultaneously analyzing CLM data from contiguous groupings of AEI readers. Referring to FIG. 5, for example, an AEI reader 20 at a first location may have a probability distribution 22 for an ETA at a destination AEI reader 24. The probability distribution 22 has a relatively large variance and standard deviation resulting from the fact that the route to the destination splits along two paths of greatly differing lengths. However, this is evident from an analysis of the nearby AEI readers 26 and 30, and their associated probability distributions 28 and 32, respectively. The probability distribution 26, along the shorter route, has a shorter ETA than that of the ETA of reader 20, and a much tighter distribution. Similarly, the distribution 32 associated with AEI reader 30 has a tighter distribution, but a longer ETA than that of the ETA of reader 20. By analyzing the probability distributions of groups of AEI readers, this condition can be identified, and if present, the probability distributions of AEI readers 26 and 30 may be used to redistribute the distribution of AEI reader 20 about two means, each having its own variance about the mean. Alternatively, the probability distribution of AEI reader 22 may be analyzed directly to see whether it results from the sum of two distributions, each centered around a respective mean and each with a tighter distribution than that of the whole.

If the condition described in the preceding paragraph is present, GPS data may be used to glean advance notice of which path a rail car is on, and on that basis, filter the probability distribution of AEI reader 20 to achieve a more accurate ETA, or alternatively, to select one of the ETAs of the subsequent AEI readers and use the Great Circle Distance Formula as previously described to modify the selected ETA. Specifically, in the circumstance just described, a relatively small number of GPS readings received from locations between either AEI reader 20 and AEI reader 26, or AEI reader 20 and AEI reader 30 should provide a statistically significant number of readings with which the two sub-distributions of AEI reader 20 may be distinguished. Once this statistically significant number has been achieved, the track between the respective AEI readers has been sufficiently "mapped" so that subsequent GPS readings may be used to determine which sub-distribution to follow.

Another possible filter mechanism is to use the speed or velocity returned by a GPS reading subsequent to an AEI reader. As stated previously, in some circumstances, a probability distribution associated with an AEI reader will be spread out about a mean or average due to frequent bottleneck situations. In that circumstance, like that of the preceding paragraph, the probability distribution may be capable of being decomposed into different sub-distributions, each one centered on whether or not, or what amount of, backlog exists. Therefore, which sub-distribution a car is following should be highly correlated with the speed of the car. In this manner, like the filter discussed in the preceding paragraph, a relatively few number of GPS readings should provide a sufficient database to associate the subsequent speed of a rail car with the particular sub-distribution it is following, and a better ETA given accordingly.

Over time, it may be preferable to augment or replace the existing CLM-based data with GPS-based data so that the current, highly discrete system of sporadic AEI readers gradually approaches point specificity, i.e continuity, as more and more GPS readings are received. As noted earlier, development of such a continuous system faces a serious obstacle in that GPS readings are so finely located that very few readings will occur at precisely the same location. Thus, for such a system to be achieved, areas along a track would have to be grouped discretely. Two issues then arise. First, what size would be an appropriate area within which to conglomerate all GPS readings received therein, and second, how many GPS readings would be needed to achieve a certain confidence in an average ETA.

Figure 6:
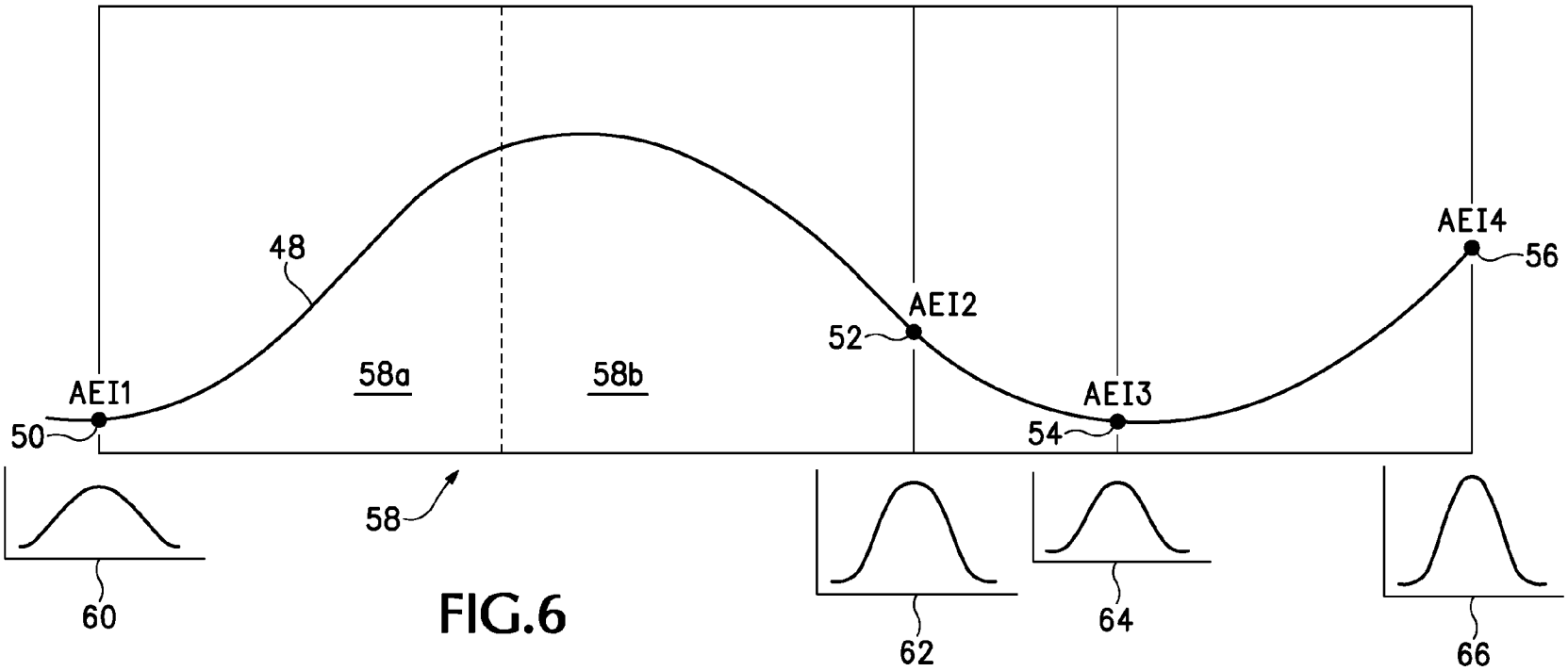
FIG. 6 shows a schematic illustration of a method of enhancing the granularity of a CLM data system utilizing GPS information received from rail cars between AEI readers.

Referring to FIG. 6, the present inventors realized that the existing network of AEI readers could be used as a solution to both of these questions. A railroad track 48 may have a plurality of existing AEI readers 50, 52, 54, and 56 dispersed thereon, each with an associated probability distribution 60, 62, 64, and 66, respectively, for an ETA at an arbitrary destination. The areas between adjacent AEI readers may be respectively bounded, as shown for example by area 58 bounded by readers 50 and 52. Initially, all GPS readings between these two AEI readers will be conglomerated as if received from a single point, with the arrival time at the destination, along with any other desired parameter recorded.

The present inventors also realized that, although the respective ETAs recorded for each GPS reading should be expected to vary considerably, particularly given the large areas of the bounded boxes, the ETAs normalized to the distance from the GPS readings to the destination should not. The inventors also realized that, because the probability distribution of the surrounding AEI readers were based on a fixed location, those distributions could also themselves be normalized by their respective distances to the destination. This would enable a direct comparison between a reliability measure of a nearby AEI distribution, and an increasingly accurate (as more GPS readings are received) reliability measure of a GPS-based distribution between adjacent AEI readers bounding a GPS box may have a standard deviation of "x" normalized for the distance to the destination. When the probability distribution of a GPS bounding region achieves that standard deviation, subsequent GPS readings within that bounding region may be assigned the average ETA of the GPS readings in the bounding region, and with the same confidence as if it were assigned an ETA from an adjacent AEI reader.

Once a bounding box is being used to provide actual ETAs for freight traffic, the bounding box may be subdivided into two equal sub-regions, such as 58*a* and 58*b*, and GPS readings within those respective boxes associated with actual times of arrival, normalized for distance, until the threshold reliability measure is reached, then subdivided, etc., so that over time, the railroad track 48 has a GPS-based database that approaches point specificity.

It is at least conceivable that a very small number of GPS readings within a bounding region will coincidentally be associated with actual arrival times sufficiently proximate to each other to artificially achieve the threshold reliability measure. For that reason, it may be desirable to have as an additional condition for using GPS readings within a bounding region and further sub-dividing the bounding box, that a threshold number of readings be reached. This threshold number should preferably be sufficient to achieve statistical significance and therefore be proportional to the area within the bounding region.

It should be understood that although much of the foregoing discussion was centered on ETA estimation from a statistical database of CLM and/or GPS readings, other parameters than ETA estimation may similarly be estimated or inferred from a combination of CLM and GPS data, as previously discussed. For example, applicant's co-pending application Ser. No. 11/521,818, the disclosure of which is hereby incorporated by reference, discloses in detail a car hire accounting system in which renters of railroad equipment are generally charged an amount for the use of railroad equipment by time or by mileage, but are also credited with monetary amounts against balances owed based on various used "reclaims." Some reclaims may be based on an agreement with the owner to not apply the rate for a fixed amount of days or a fixed amount of miles, for example. Thus, in a circumstance where a rate is applied on a per-day basis, with a credit for a fixed amount of initial miles traveled, the combined CLM/GPS system disclosed herein may provide a better estimate of a time at which the initial miles traveled credit expired. Similarly, if a rate were applied on a mileage basis, with a credit for a fixed amount of time after departure or before arrival, the presently disclosed combined CLMIGPS [CLM/GPS] system could better estimate the location at which the time expired.

Furthermore, the disclosed systems for a combined system may preferably be used in North America, which uses an extensive shared network of railroad track, and a similarly extensive network of CLM readers. However, to the extent that similar transponder-based tracking networks exist elsewhere in the world, the disclosed systems and methods may be used in those regions as well.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only the claims that follow.

What is claimed is:

1. A method comprising:

(a) receiving with a processing device and from a GPS transmitter a location along a route between a first fixed site and a destination, said first fixed site proximate an AEI reader and respectively associated with said destination by a statistically calculated parameter comprising an estimated time of travel to said destination, calculated based on a probability distribution of respective historical travel times of a population of rail cars between said first fixed site and said destination; and (b) modifying with the processing device the estimated time of travel based upon the received location by filtering said probability distribution.

2. The method of claim 1 where the received location is expressed in latitude and longitude coordinates and the parameter is modified by the steps of:

(a) respectively retrieving the latitude and longitude coordinates for the first fixed site and the destination;

(b) using the Great Distance Formula and the received location, calculating the fractional distance the vehicle has yet to travel between the first fixed site and the destination; and (c) multiplying the fractional distance by the estimated time to arrive at the destination.

3. The method of claim 1 where the route includes a third fixed site between the first site and the destination, the third site being associated with the destination by a statistically calculated second estimated time to arrive at the destination, where the received location is expressed in latitude and longitude coordinates and the parameter is modified by the steps of:

(a) respectively retrieving the latitude and longitude coordinates for the first fixed site and the destination;

(b) using the Great Distance Formula and the received location, calculating the fractional distance the vehicle has yet to travel between the first fixed site and the destination multiplied by the difference between the estimated time to arrive at the destination from the first fixed site and the second estimated time to arrive at the destination from the first fixed site; and (c) adding the calculation of step (b) to the estimated time to arrive at the destination from the third fixed site.

4. The method of claim 1 where the route includes a third fixed site between the first fixed site and the destination, the third site being associated with the destination by a statistically calculated second estimated time to arrive at the destination, where each of the statistically calculated estimated time to arrive at the destination and the second estimated time to arrive at the destination have an associated standard deviation, where the received location is expressed in latitude and longitude coordinates, and where the parameter is modified by the steps of:

(a) if the received location is after the third fixed site along the route:

(i) respectively retrieving the latitude and longitude coordinates for the third fixed site and the destination;

(ii) using the Great Distance Formula and the received location, calculating the fractional distance the vehicle has yet to travel between the third fixed site and the destination; and (iii) multiplying the fractional distance by the estimated time to arrive at the destination from the third fixed site;

(b) if the received location is prior to the third fixed site along the route, and if the standard deviation associated with the statistically calculated time to arrive at the destination is greater than the standard deviation associated with the statistically calculated second time to arrive at the destination:

(iv) respectively retrieving the latitude and longitude coordinates for the first fixed site and the destination;

(v) using the Great Distance Formula and the received location, calculating the fractional distance the vehicle has yet to travel between the first fixed site and the destination multiplied by the difference between the estimated time to arrive at the destination from the first fixed site and the second estimated time to arrive at the destination from the first fixed site; and (vi) adding the calculation of step (b) to the estimated time to arrive at the destination from the third fixed site; and (c) otherwise:

(vii) respectively retrieving the latitude and longitude coordinates for the first fixed site and the destination;

(viii) using the Great Distance Formula and the received location, calculating the fractional distance the vehicle has yet to travel between the first fixed site and the destination; and (ix) multiplying the fractional distance by the estimated time to arrive at the destination.

5. The method of claim 1 where the received location is used to calculate a rate of progress of a rail car traveling the route and the probability distribution is filtered to include only those rail cars having a similar rate of progress.

6. The method of claim 5 where the determination of whether a railcar in the probability distribution has a similar rate of progress is based on at least one of:

(a) the difference between the time of arrival at a third fixed site along said route and the time of arrival at the first fixed site; and (b) the difference between the time of reporting at a variable location by a GPS transmitter and the time of arrival at the destination.

7. A method of automatically modifying a statistical database stored on a computer-readable medium and operatively connected to a processing device, said statistical database respectively associating actual arrival times of each of a plurality of railroad freight cars at a destination with a location representative of an area along a route of travel of the plurality of railroad freight cars, using respectively received first time information sent from a one of the plurality of railroad freight cars while present in the area and second time information received at the arrival at the destination, said method comprising:

(a) receiving with the processing device, first time information for a respective one of the plurality of railroad freight cars and the processing device associating that respective first time information with second time information received for the respective one of the plurality of railroad freight cars when it arrives at the destination;

(b) repeating step (a) for a plurality of respective ones of the plurality of railroad freight cars sending respective first time information within the area;

(c) subsequently subdividing, with the processing device, the area along the route of travel into a plurality of new sub-areas, each new sub-area represented by a location within the respective new sub-area to be associated in the database with actual arrival times of the plurality of railroad freight cars at the destination; and (d) repeating steps (a) to (c) with respect to each new, subdivided sub-area.

8. The method of claim 7 where the location representative of the area along a route of travel is co-extensive with that area.

9. The method of claim 7 where at least one location representative of an area is a CLM data point.

10. The method of claim 7 where a CLM data point either bounds the area or is included in the area.

11. The method of claim 7 where the step of subdividing the area along the route of travel is conditioned on a sufficient statistical correlation between a first distribution of associated arrival times at the destination from the location within the area and a second distribution of associated arrival times at the destination from a selected one of:

(a) a second distribution of associated arrival times at the destination from the CLM data point; or (b) a second distribution of associated arrival times at the destination from a location associated with a second area, from which the area was subdivided.

12. The method of claim 11 where the statistical correlation is based on:

(a) the respective variances about a mean of the first and second distribution; and (b) the respective standard deviations of the first and second distribution.

13. The method of claim 7 where the first time information is received from a GPS transmitter.

14. The method of claim 13 where the statistical database is used to estimate a projected arrival time at the destination of a railroad freight car that sends the first time information from within the area.

15. The method of claim 14 where the projected arrival time is calculated by modifying an estimated arrival time from a CLM data point using prior first time information received from said plurality of railroad freight cars.

* * * * *

UNITED STATES PATENT AND TRADEMARK OFFICE

CERTIFICATE OF CORRECTION

PATENT NO. : 8,731,746 B2
APPLICATION NO. : 12/129598
DATED : May 20, 2014
INVENTOR(S) : Dan Weiler It is certified that error appears in the above-identified patent and that said Letters Patent is hereby corrected as shown below:

In the Specification

At column 4, line 30, please change "Throwing" to read --Knowing--.

Signed and Sealed this
Sixteenth Day of June, 2015

Michelle K. Lee

Michelle K. Lee
*Director of the United States Patent and Trademark Office*